US010443597B2

(12) United States Patent
Ribarov et al.

(10) Patent No.: US 10,443,597 B2
(45) Date of Patent: Oct. 15, 2019

(54) GEARS AND GEAR PUMPS

(71) Applicant: Hamilton Sundstrand Corporation, Charlotte, NC (US)

(72) Inventors: Lubomir A. Ribarov, West Hartford, CT (US); Leo J. Veilleux, Jr., Wethersfield, CT (US); James S. Elder, Jr., South Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 646 days.

(21) Appl. No.: 14/993,406

(22) Filed: Jan. 12, 2016

(65) Prior Publication Data

US 2017/0198694 A1 Jul. 13, 2017

(51) Int. Cl.

| | |
|---|---|
| ***F04C 15/00*** | (2006.01) |
| ***F04C 2/08*** | (2006.01) |
| ***F04C 2/18*** | (2006.01) |

(52) U.S. Cl.

CPC ..... *F04C 15/0049* (2013.01); *F04C 2/088* (2013.01); *F04C 2/18* (2013.01)

(58) Field of Classification Search

CPC ..... F04C 15/0049; F04C 2/088; F04C 2/18
USPC ..... 418/205
See application file for complete search history.

(56) References Cited

U.S. PATENT DOCUMENTS

| | | | | |
|---|---|---|---|---|
| 1,870,192 | A * | 8/1932 | Butler | F01C 21/102 222/236 |
| 3,953,160 | A | 4/1976 | Bottoms | |
| 3,981,646 | A | 9/1976 | Bottoms | |
| 4,097,206 | A | 6/1978 | Schonherr | |
| 4,233,005 | A | 11/1980 | Bottoms et al. | |
| 4,290,739 | A | 9/1981 | Korse | |
| 4,682,938 | A | 7/1987 | Riordan | |
| 4,934,913 | A | 6/1990 | Pippes | |
| 5,288,556 | A * | 2/1994 | Lemelson | B01J 8/42 428/216 |
| 6,042,352 | A | 3/2000 | Halter et al. | |
| 6,123,533 | A | 9/2000 | McBurnett et al. | |
| 6,312,241 | B1 | 11/2001 | Kamamoto et al. | |
| 7,481,633 | B2 | 1/2009 | White, Jr. | |
| 7,654,806 | B2 | 2/2010 | Hanst et al. | |
| 7,878,781 | B2 | 2/2011 | Elder | |
| 8,137,085 | B2 | 3/2012 | Ni et al. | |
| 8,672,657 | B2 | 3/2014 | Masuda et al. | |
| 9,068,568 | B2 | 6/2015 | Heitz et al. | |
| 2005/0112012 | A1 | 5/2005 | Marheineke | |
| 2006/0024155 | A1 | 2/2006 | Blatchford et al. | |

(Continued)

*Primary Examiner* — Audrey K Bradley
*Assistant Examiner* — Kelsey L Stanek
(74) *Attorney, Agent, or Firm* — Locke Lord LLP; Scott D. Wofsy; Joshua L. Jones

(57) ABSTRACT

A gear pump includes a drive gear with drive gear teeth and a driven gear with driven gear teeth. The drive gear is rotatably disposed about a drive gear axis. The driven gear is rotatably disposed about a driven gear axis and is intermeshed with the drive gear such that a plurality of driven gear teeth are in sliding contact with a plurality of the driven gear teeth. One or more of the drive gear teeth or the driven gear teeth define within the tooth interior a cavity. The cavity is in fluid communication through an orifice with an inter-tooth volume defined between the contacting drive gear teeth and driven gear teeth such that fluid flows through the orifice to reduce cavitation within fluid confined within the inter-tooth volume.

16 Claims, 8 Drawing Sheets

(56) References Cited

U.S. PATENT DOCUMENTS

| | | | |
|---|---|---|---|
| 2007/0178003 | A1 | 8/2007 | Zhu et al. |
| 2012/0141316 | A1 | 6/2012 | Wakefield et al. |
| 2013/0319153 | A1 | 12/2013 | Ni |
| 2013/0320147 | A1 | 12/2013 | Lewis et al. |

* cited by examiner

GEARS AND GEAR PUMPS

BACKGROUND OF THE INVENTION

1. Field of the Invention

The present disclosure relates to gear pumps, and more particularly to gear pumps for aircraft fuel systems.

2. Description of Related Art

Gear pumps are commonly used to pressurize fluid using intermeshed gears. As the gears rotate teeth of the gears come into contact with one another at an engagement location, confining therebetween a fluid portion. The gears then rotate to a disengagement position, the teeth displacing the fluid portion confined therebetween between the engagement position and the disengagement position. Between the engagement location and disengagement location leading faces of successive teeth of one gear are in sliding contact with trailing faces of successive teeth of the other gear, and confine therein the fluid portion in an inter-tooth volume divided into a forward portion and a trailing portion by a backlash gap between the trailing face of one tooth and a leading face of the other gears. As the gears rotate toward the disengagement position, the volumes of the forward and trailing portions of the inter-tooth volume change. The volume change causes pressure change within the inter-tooth volume that is typically relieved by fluid flow through the inter-tooth gap. In some gear pumps fluid flow through the backlash gap can induce pressures changes within the inter-tooth volume that cause localized vapor bubbles to form and collapse, potentially eroding surfaces and structures bounding the inter-tooth volume. Such erosion can change the inter-tooth volume geometry and influence pump performance.

Such conventional methods and systems have generally been considered satisfactory for their intended purpose. However, there is still a need in the art for improved gear pump devices. The present disclosure provides a solution for this need.

SUMMARY OF THE INVENTION

A gear pump includes a drive gear with drive gear teeth and a driven gear with driven gear teeth. The drive gear is rotatably disposed about a drive gear axis. The driven gear is rotatably disposed about a driven gear axis and is intermeshed with the drive gear such that a plurality of driven gear teeth are in sliding contact with a plurality of the driven gear teeth. One or more of the drive gear teeth or the driven gear teeth define within the tooth interior a cavity. The cavity is in fluid communication through an orifice with an inter-tooth volume defined between the contacting drive gear teeth and driven gear teeth such that fluid flows through the orifice to reduce cavitation within fluid confined within the inter-tooth volume.

In certain embodiments, the gear tooth can have a line of action defined along a leading flank of the tooth. The line of action can separate a root portion of the gear tooth flank and a working portion of the gear tooth flank. The orifice can be disposed on the working portion of the gear tooth flank. The orifice can be disposed on the root portion of the gear tooth flank. The orifice can be disposed on both the working portion and the root portion of the gear tooth flank such that the line of action of the gear tooth flank intersects the orifice. It is contemplated that the orifice can define a flow area with a circular shape, a rectangular shape, an elliptical shape, or any other shape as suitable for an intended application.

In accordance with certain embodiments, the orifice can be a first orifice, and the leading flank of the gear tooth can define a second orifice fluidly coupling the interior cavity with the external environment. Both the first orifice and the second orifice can be disposed on the working portion of the gear tooth flank. Both the first orifice and the second orifice can be disposed on the root portion of the gear tooth flank. The first orifice can be on the working portion of the gear tooth flank, and the second orifice can be on the root portion of the gear tooth flank. The line of action of the gear tooth can intersect the first orifice, and the second orifice can be disposed on the working portion of the gear tooth flank or the root portion of the gear tooth flank.

It is also contemplated that, in accordance with certain embodiments, the cavity can be a variable volume cavity. A compressible insert can be fixed within the cavity. The compressible insert can include a polymeric material, a fluoropolymer elastomer, or a fluoro-silicone material. Either or both of the drive gear and the driven gear can include a metal or metal alloy, such as carbon steel, stainless steel, a nickel alloy, an aluminum alloy, a cobalt-chromium, or any other suitable alloy. Either or both of the drive gear and the driven gear can include a plurality of interfused layers, such layers fused to one another using a selective laser sintering technique, a direct metal laser sintering technique, a selective laser melting technique, an electron beam melting technique, or any other suitable additive manufacturing technique.

A gear pump assembly includes a housing with an inlet and an outlet, a drive gear disposed between the inlet and the outlet, a driven gear with teeth intermeshed with teeth of the drive gear and disposed between the inlet and the outlet, and first and second bearing carriers disposed on axially opposite sides of the drive gear and the driven gear. The bearing carriers rotatable support the drive gear along a drive gear axis and the driven gear along a driven gear axis. Each of the teeth of the drive gear define within the respective tooth interior an internal cavity that is in fluid communication with the inlet and the outlet through an orifice defined in a leading flank of the tooth to flow fluid through the orifice and reduce cavitation within fluid disposed within the housing.

A method of controlling cavitation includes confining fluid flanks of intermeshed gear teeth, receiving fluid within a cavity defined within one of the gear teeth responsive to pressure increase in the fluid confined between the intermeshed gear teeth, and discharging fluid from the cavity responsive to pressure decrease in fluid confined between the intermeshed gear teeth.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
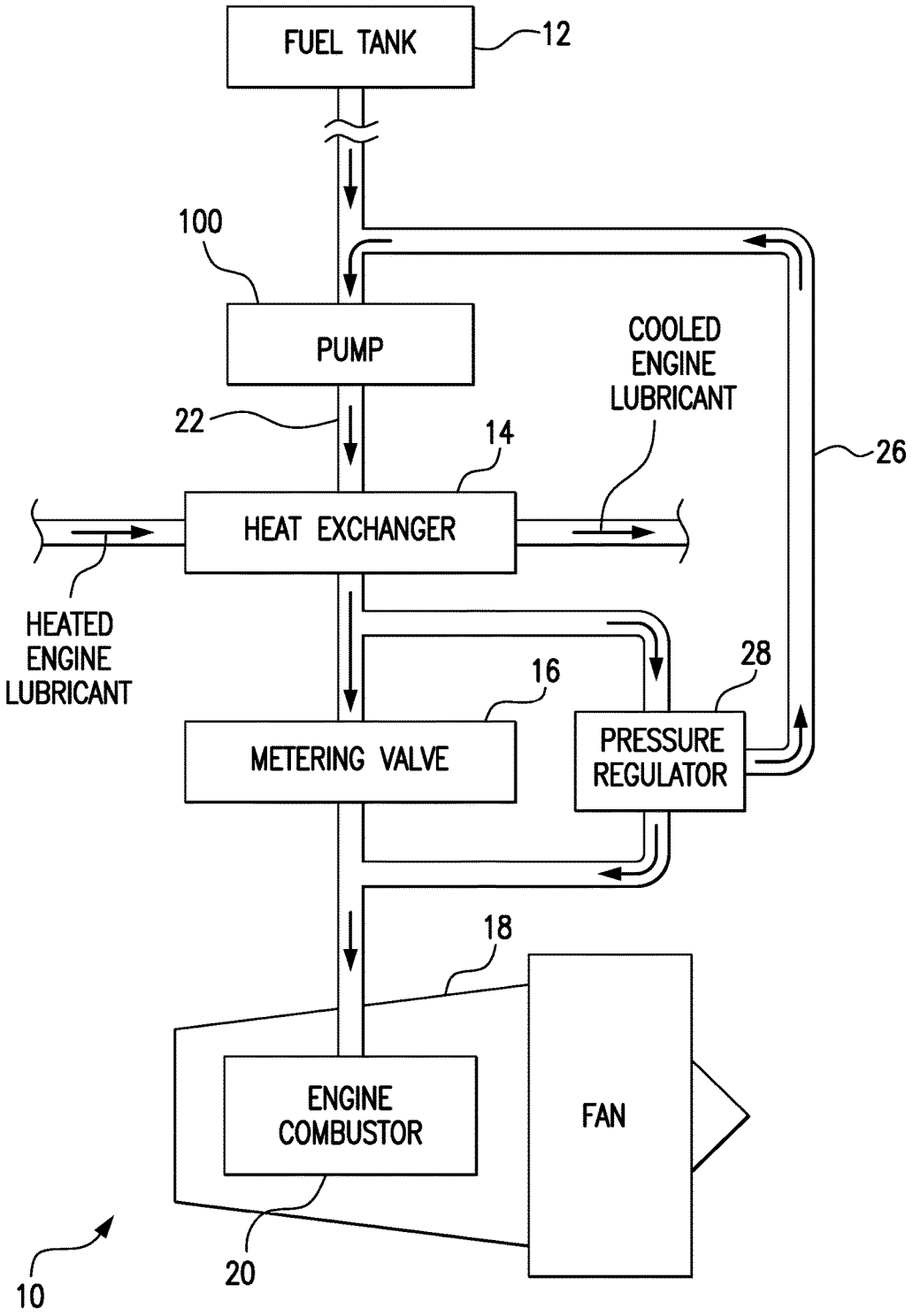
FIG. 1 is a schematic view of an exemplary embodiment of a fuel system constructed in accordance with the present disclosure, showing a gear pump.

Reference will now be made to the drawings wherein like reference numerals identify similar structural features or aspects of the subject disclosure. For purposes of explanation and illustration, and not limitation, a partial view of an exemplary embodiment of a gear pump in accordance with the disclosure is shown in FIG. 1 and is designated generally by reference character 100. Other embodiments of gear pumps and fuel systems incorporating gear pumps in accordance with the disclosure, or aspects thereof, are provided in FIGS. 2-7F, as will be described. The systems and methods described herein can be used in fuel systems, such as in aircraft fuel systems, however the invention is not limited to fuel systems or to aircraft in general.

Referring to FIG. 1, a fuel system 10 for an aircraft is shown. Fuel system 10 includes a fuel tank 12, a gear pump 100, a heat exchanger 14, a metering valve 16, and an engine 18 with a combustor 20. Fuel tank 12 is in fluid communication with combustor 20 through a supply conduit 22 that interconnects gear pump 100 with fuel tank 12, heat exchanger 14 with gear pump 100, metering valve 16 with heat exchanger 14, and combustor 20 with metering valve 16. Heat exchanger 14 is in fluid communication with a lubrication system of engine 18 (not shown for clarity reasons), receives heated engine lubricant therefrom, transfers heat from the heated lubricant into fuel traversing fuel system 10, and returns cooled engine lubricant to engine 18. Metering valve 16 divides heated fuel provided thereto into an engine flow and a return flow according to a throttle setting associated with engine 18, a portion of the heated fuel returning to fuel system 10 through a pressure regulator and a bypass conduit for recirculation through fuel system 10.

Figure 2:
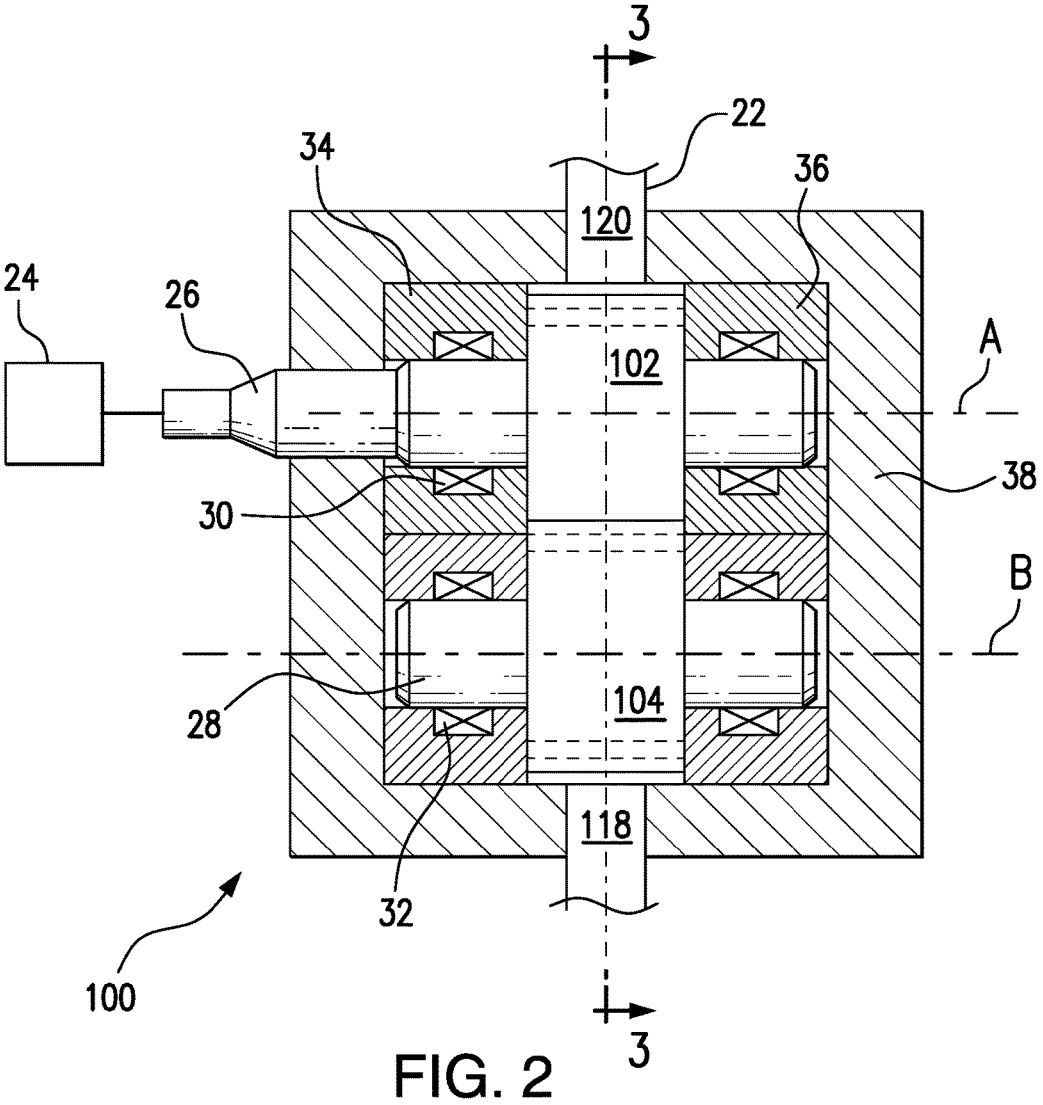
FIG. 2 is a schematic cross-sectional side view of the gear pump of FIG. 1, showing a drive gear intermeshed with a driven gear within an interior of the gear pump.

With reference to FIG. 2, gear pump 100 is shown. Gear pump 100 includes a drive gear 102, a driven gear 104, a drive gear shaft 26, and a driven shaft 28. Gear pump 100 also includes drive shaft bearings 30, driven shaft bearings 32, first bearing carrier 34, a second bearing carrier 36, and a housing 38. Housing 38 is in fluid communication through an inlet 118 and an outlet 120 with supply conduit 22 of fuel system 10 (shown in FIG. 1).

Drive gear 102, drive gear shaft 26, drive shaft bearings 30, first bearing carrier 34, and second bearing carrier 36 are disposed within housing 38. Drive gear 102 is fixed to drive gear shaft 26. Drive gear shaft 26 is rotatably supported for rotation about drive shaft axis A by drive shaft bearings 30. Drive shaft bearings 30 are seated within first bearing carrier 34 and second bearing carrier 36. First bearing carrier 34 and second bearing carrier 36 are fixed within housing 38 on axially opposite ends of drive gear 102. Drive gear shaft 26 is operably connected to a source of mechanical rotation, such as a motor or an accessory gearbox 24.

Driven gear 104, driven gear shaft 28, and driven shaft bearings 32 are also disposed within housing 38. Driven gear 104 is fixed to driven gear shaft 28 and is intermeshed with drive gear 102 between inlet 118 and outlet 120. Driven gear shaft 28 is rotatably supported for rotation about drive shaft axis B by driven shaft bearings 32. Driven shaft bearings 32 are seated within first bearing carrier 34 and second bearing carrier 36 on axially opposite ends of driven gear 104. While illustrated in FIG. 2 as a single stage gear pump, it is to be appreciated that gear pump 100 can include more than one stage, the second stage being operably connected to driven gear shaft 28 by way of non-limiting example.

Figure 3:
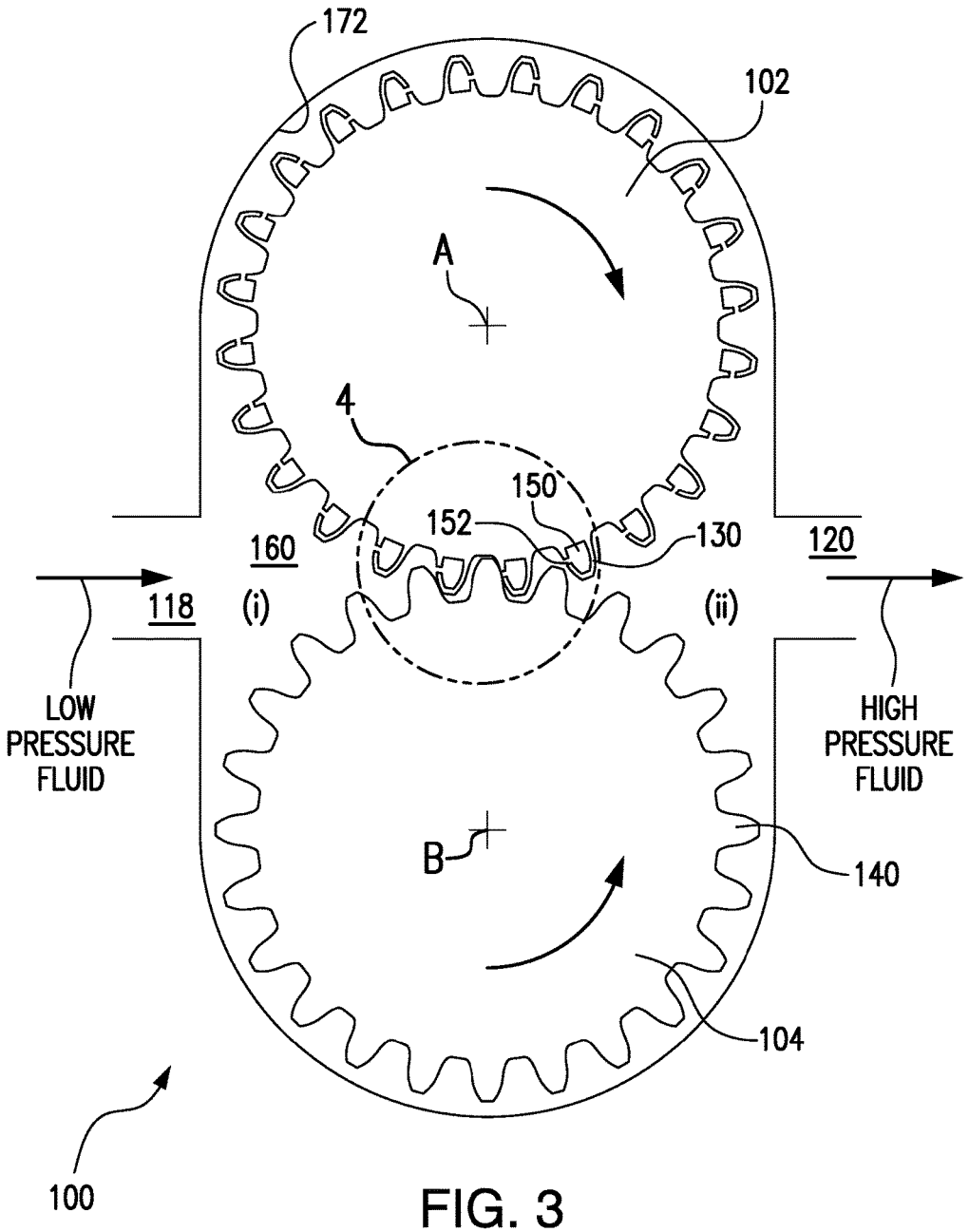
FIG. 3 is a schematic cross-sectional end view of the gear pump of FIG. 1 taken along cut line 3-3 indicated in FIG. 2, showing the intermeshed drive gear teeth and driven gear teeth with cavities defined within the teeth interior.

With reference to FIG. 3, gear pump 100 is shown from the perspective of second bearing carrier 36 (shown in FIG. 2). Drive gear 102 includes a plurality of drive gear teeth 130 and is rotatably supported for rotation in a clockwise direction about drive gear axis A within a pumping chamber 160. One or more of drive gear teeth 130 have cavities 150 that are in selective fluid communication with pumping chamber 160 through respective orifices 152. Driven gear 104 includes a plurality of driven gear teeth 140 and is rotatably supported for rotation in a counterclockwise direction about driven gear axis B within pumping chamber 160. Between inlet 118 and outlet 120, drive gear teeth 130 of drive gear 102 intermesh with driven gear teeth 140 of driven gear 104 between an engagement position (i) proximate inlet 118 and a disengagement position (ii) proximate outlet 120.

Rotation of drive gear 102 and intermeshed driven gear 104 within pumping chamber 160 drives fluid about a periphery of gear pump chamber 160, causing fluid exiting outlet 120 to have greater pressure than fluid entering inlet 118. Rotation of drive gear 102 and intermeshed driven gear 104 can also cause localized regions of low fluid pressure to develop within the gear pump chamber, such as at a location proximate to disengagement position (ii) where teeth of drive gear 102 and driven gear 104 unmesh. Under certain pump operating conditions, fluid pressure proximate to disengagement position (ii) can approximate the fuel vapor pressure and cause fuel vapor to form within the region of low fluid pressure, which can lead to bubble formation within the fluid. As will be appreciated by those of skill in the art in view of the present disclosure, such bubbles generally collapse after formation and generate shock waves that travel through the fluid and impact gear pump structures bounding the fluid. The shock waves can erode the surfaces gear pump structures bounding pumping chamber 160, potentially reducing pump efficiency.

Figure 4:
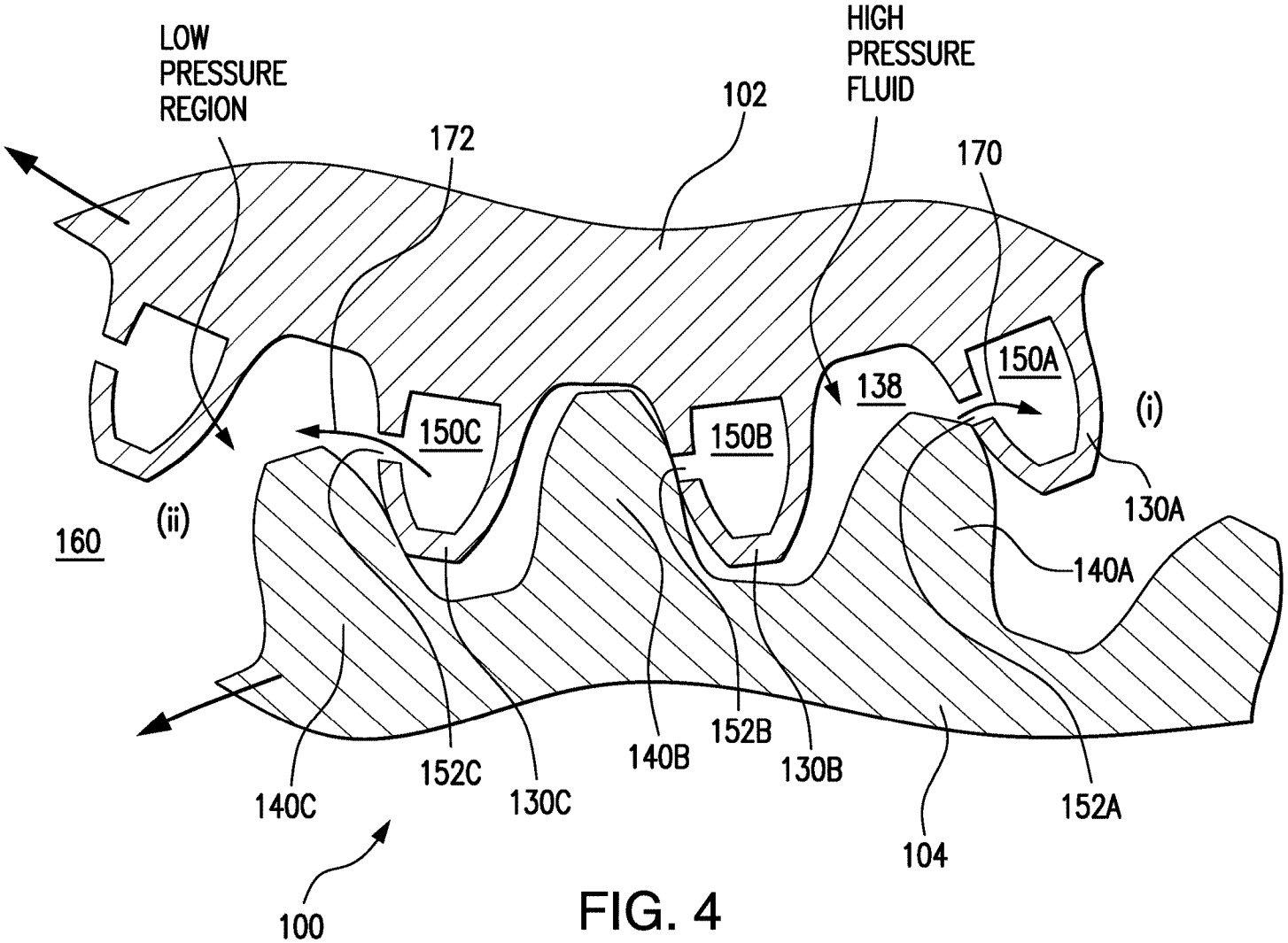
FIG. 4 is an enlargement of intermeshed teeth drive gear teeth and driven gear teeth of the gear pump at the location indicated in FIG. 3, showing gear tooth cavities charging with high-pressure fluid, carrying high pressure fluid to a region of low pressure, and discharging high-pressure fluid into a region of low fluid pressure with the gear pump pumping chamber, according to an embodiment.

With reference to FIG. 4, intermeshed drive gear teeth, e.g., drive gear tooth 130A, drive gear tooth 130B, and drive gear tooth 130C, and driven gear teeth, e.g., driven gear tooth 140A, driven gear tooth 140B, and driven gear tooth 140C, are shown. The cavities and orifices disposed within the respective drive and driven gear teeth are configured and adapted to (a) receive high-pressure fluid from a region of high pressure within pumping chamber 160, (b) carry the high-pressure fluid to a region of low fluid pressure within pumping chamber 160, and (c) discharge the high-pressure fluid into the region of low fluid pressure. This discharge of the high-pressure fluid increases the fluid pressure within the region of low fluid pressure, thereby making it less likely that bubbles will form within the region of low fluid pressure, reducing cavitation, and increasing the service life of gear pump 100.

With respect to receiving high-pressure fluid from a region of high pressure, attention is directed to a first drive gear tooth 130A. As first drive gear tooth 130A comes into contact with first driven gear tooth 140A a leading flank of first drive gear tooth 130A comes into contact with a trailing flank of driven gear tooth 140A proximate to engagement position (i). The contacting flanks confine a fluid portion within an inter-tooth volume 138. As drive gear 102 and driven gear 104 rotate the trailing flank of first driven gear tooth 140A slides upwards (relative to FIG. 4) across the leading flank of first drive gear tooth 130A, shrinking volume of inter-tooth volume 138, and increasing the pressure of fluid confined within inter-tooth volume 138.

Inter-tooth volume 138 is initially in fluid communication with cavity 150A through the orifice leading to cavity 150A. Consequently, as inter-tooth volume 138 gets smaller and the fluid confined therein increases in pressure, a high-pressure fluid flow 170 enters cavity 150A through an orifice 152A of first drive gear tooth 130A. High-pressure fluid flow 170 continues to charge cavity 150A with high-pressure fluid until such time as rotation of drive gear 102 and driven gear 104 causes the trailing flank of driven gear tooth 140A to occlude orifice 152A, at which point high-pressure fluid flow 170 ceases. This is illustrated with the positional arrangement of second drive gear tooth 130B and second driven gear tooth 140B, where the trailing flank of second drive gear tooth 140B occludes (i.e. blocks) orifice 152B, thereby preventing fluid flow into cavity 150B defined within second drive gear tooth 130B. As will be appreciated by those of skill in the art in view of the present disclosure, the trailing flank of second drive gear tooth 140B blocks second drive gear tooth orifice 152B for a portion of rotation of drive gear 102, causing the high pressure fluid retained therein to be displaced at pressure from a location proximate engagement position (i) to a location proximate tooth disengagement position (ii).

It is contemplated that the orifice leading into gear tooth retain the high-pressure fluid charge becomes unblocked at a rotational position proximate a region of low fluid pressure within pumping chamber. In this respect attention is directed to third drive gear tooth 130C, where orifice 152C to cavity 150C is unblocked, and from which a flow of high-pressure fluid issues as a discharge flow 172 into the region of low fluid pressure proximate disengagement position (ii). As will be appreciated by those of skill in the art in view of the present disclosure, the rotational position where the orifice becomes unblocked is determined by the location of the orifice—which in the illustrated exemplary embodiment is in the root of the tooth—thereby allowing the unblocking to coincide with arrival of the tooth at a region within pumping chamber 160 otherwise prone low pressure and, hence, cavitation. Issue of discharge flow 172 into low-pressure fluid region reduces the propensity of dissolved gases in fluid resident in the region of low fluid pressure to form bubbles. As this locally increases fluid pressure, the likelihood of cavitation erosion is reduced as the propensity of the fluid pumped by the gear pump to flash into a two-phase flow mixture from the pressure drop that takes place as the drive gear and driven gear teeth unmesh is reduced.

Figure 5:
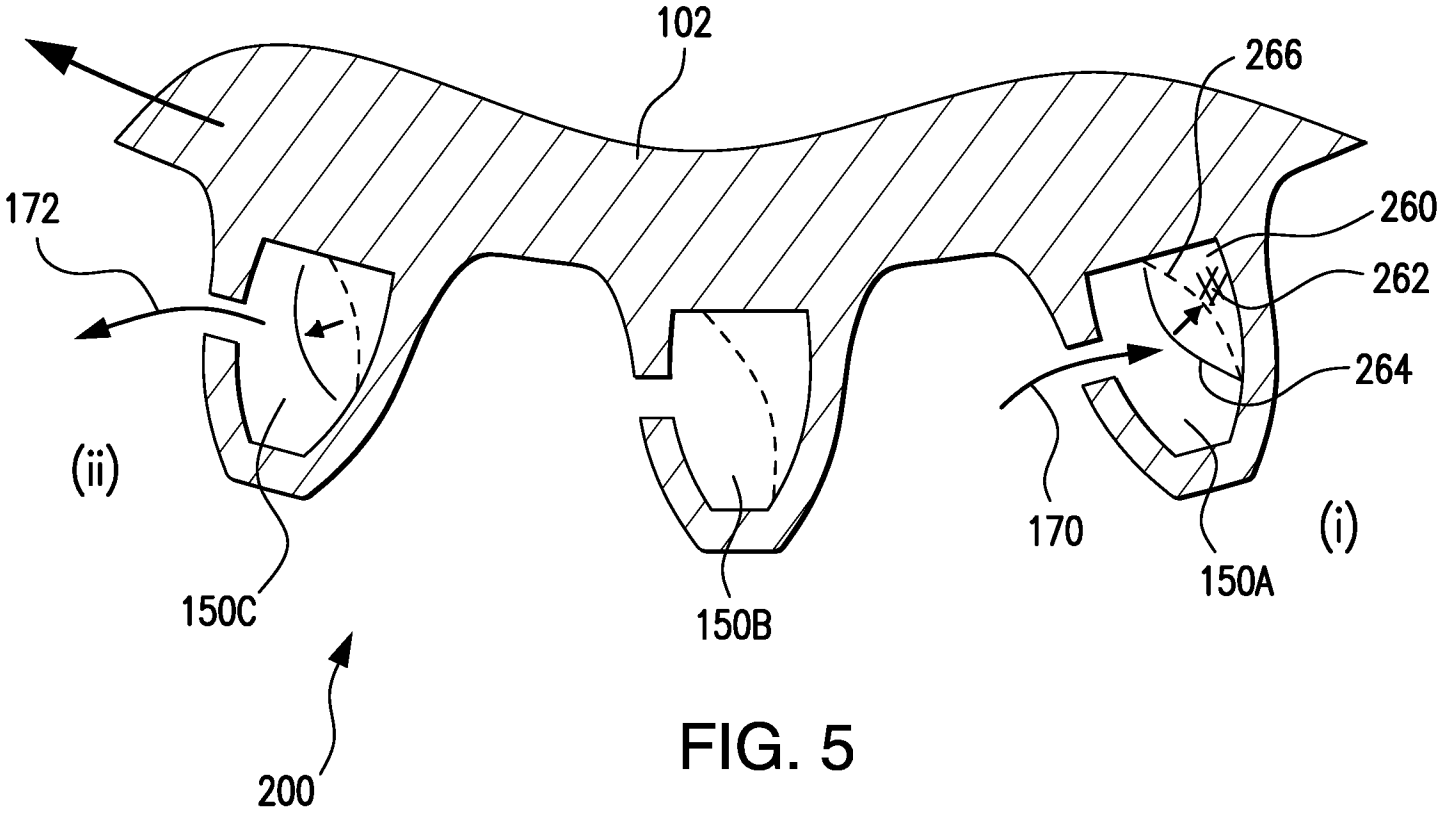
FIG. 5 is schematic view of a drive gear of the gear pump of FIG. 1, showing drive gear teeth with cavities including compressible inserts, according to an embodiment.

With reference to FIG. 5, a gear pump 200 is shown. Gear pump 200 is similar to gear pump 100, and additionally includes a compressible insert 260. Compressible insert 260 includes a compressible material 262 and is disposed within one or more of the cavities of the drive gear teeth of the drive gear, e.g., first drive gear tooth 150A, second drive gear tooth 150B, and third drive gear tooth 150C. Compressible material 262 reduces its volume in response to the application of pressure from fluid entering the tooth cavity, thereby rendering the gear tooth cavity a variable volume gear tooth cavity.

As high-pressure fluid enters a gear tooth cavity, shown with high-pressure fluid flow 170 entering first drive gear tooth 150A, high-pressure fluid flow 170 exerts pressure on the insert. The force causes the compresses compressible insert 260, displacing a surface of compressible insert 260 from an expanded position 264 (shown in solid outline) to a compressed position 266 (shown in dashed outline). This loads compressible insert 260 with a spring force that, when the cavity orifice becomes unblocked, accelerates discharge of high-pressure fluid from the gear tooth cavity, as shown in an exemplary manner with discharge flow 172 issuing from third gear tooth cavity 150C.

It is contemplated that compressible material 262 include be a lightweight compressible material, such as a polymeric, a fluoro-silicone, and/or a fluoropolymer material.

Advantageously, embodiments of gear pumps having such compressible materials can retain their mechanical integrity and elasticity in corrosive environments while further reducing the net bulk modulus of the fluid and enhancing the accumulator effect of the tooth cavity. Examples of suitable fluoro-silicone materials include those marketed under the tradename Silastic®, available from Dow Corning Corporation of Midland, Mich. Examples of suitable fluoropolymer materials include those marketed under the tradename Viton®, available from E. I. Du Pont De Nemours & Company of Wilmington, Del.

Figure 6:
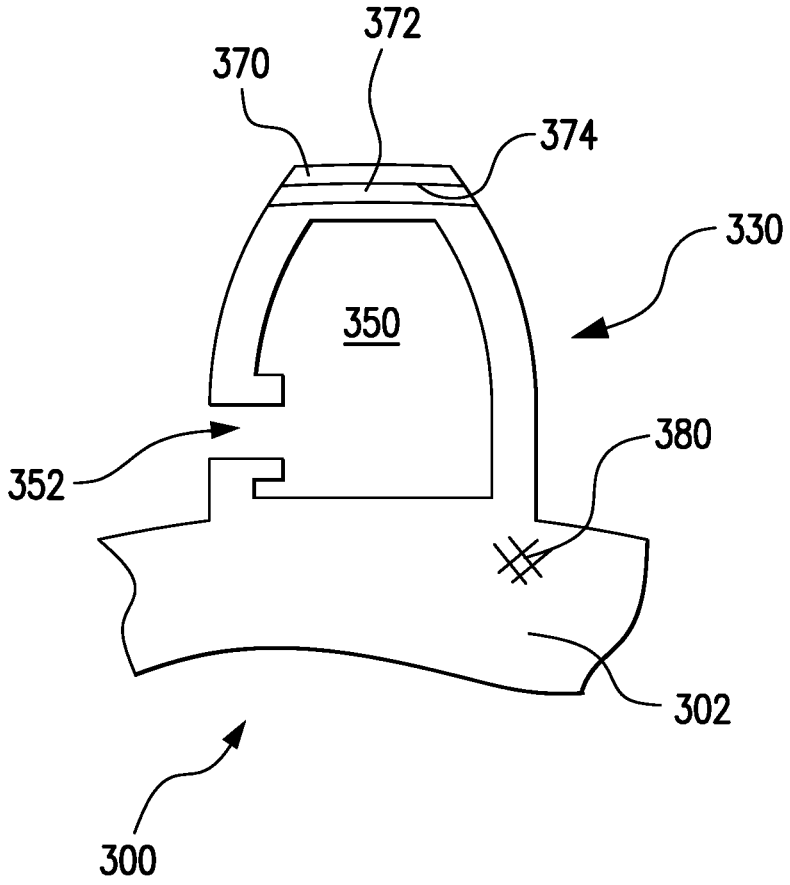
FIG. 6 is schematic view of a drive gear of the gear pump of FIG. 1, showing a gear tooth including a plurality of interfused layers, according to an embodiment.

With reference to FIG. 6, a gear pump 300 is shown. Gear pump 300 is similar to gear pump 100 and additionally includes a drive gear 302 with a drive gear tooth 330 having a plurality of interfused layers. As indicated FIG. 6, drive gear tooth 330 includes a first layer 370 interfused and a second layer 372 interfused at an interface 374. Fusing first layer 370 to second layer 372 at fusing interface 374 allows for control in the internal geometry of a gear tooth cavity 350 as that of orifice 352 defined within drive gear tooth 330, enabling each tooth of the drive gear and/or the driven gear to have an internal cavity that is of substantially the same size and shape as those of the other gear teeth. Controlling the size and shape of the cavity also enables the gear to be balanced for rotation at a range of pumping speeds.

It is contemplated that first layer 370 may be interfused with second layer 372 using an additive manufacturing technique, such as a selective laser sintering technique, a direct metal laser sintering technique, a selective layer melting technique, an electron beam melting technique, or any other suitable additive manufacturing technique. Such techniques allow for drive gear 302 to include a metal of metallic alloy material 380, such as carbon steel, stainless steel, a cobalt-chromium material, a nickel-based alloy, a titanium-based alloy, and/or an aluminum alloy by way of non-limiting example.

Figure 7A:
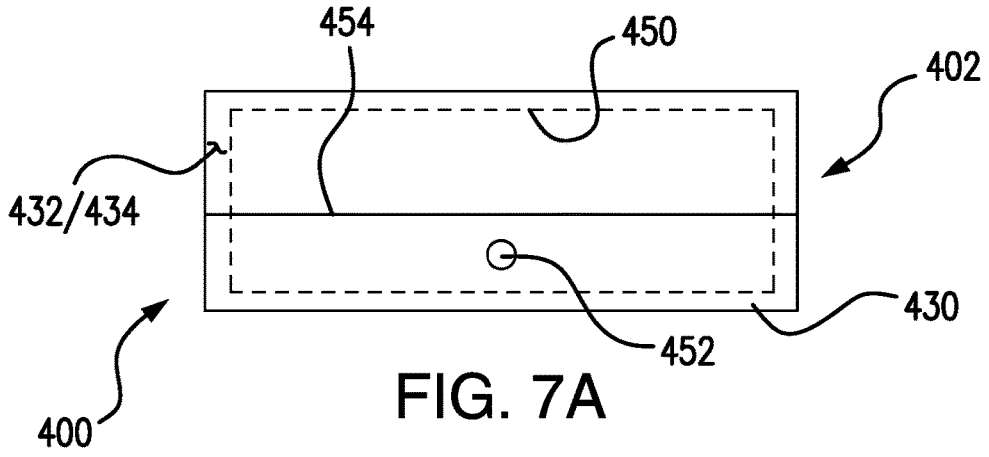
FIGS. 7A-7F are schematic views of drive gears of the gear pump of FIG. 1, showing the arrangement of orifice on flanks of drive gear teeth of the gear pump drive gears, according to embodiments.

With reference to FIGS. 7A-7F, teeth of gear pumps according to embodiments are shown. Referring to FIG. 7A, a gear pump 400 is shown. Gear pump 400 is similar to gear pump 100, and additionally includes a drive gear 402 having a drive gear tooth 430 defining a cavity 450 that is in fluid communication with the external environment through an orifice 452. Orifice 452 is circular in shape and is disposed below a lower extreme of the line of action 454 of drive gear 402 on either a leading flank 432 or a trailing flank 434 of drive gear tooth 430. Since the radial position of the orifice cooperates with the fluid's tendency to collect at the top of the gear tooth cavity prior discharge, the orifice location may delay the discharge from the gear tooth cavity subsequent to teeth of the drive gear and driven gear unmeshing.

Figure 7B:
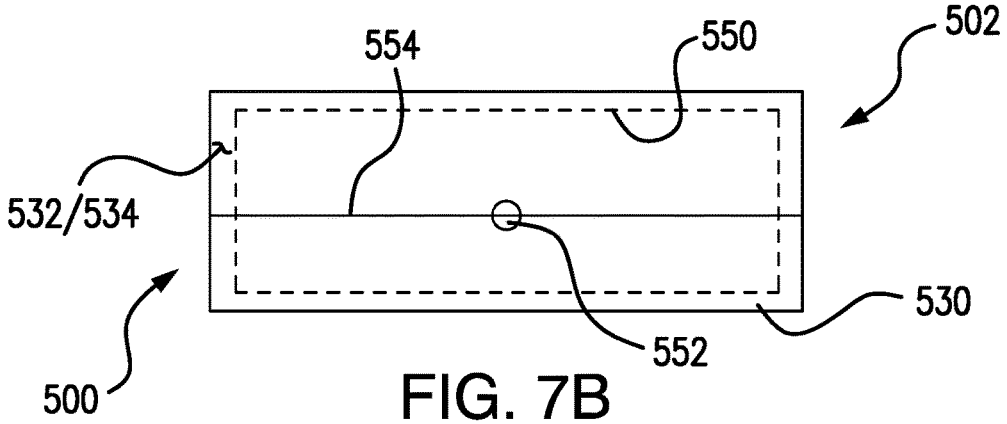

Referring to FIG. 7B, a gear pump 500 is shown. Gear pump 500 is similar to gear pump 100, and additionally includes a drive gear 502 having a drive gear tooth 530 defining a cavity 550 that is in fluid communication with the external environment through an orifice 552. Orifice 552 is circular in shape and is disposed such that a lower extreme of line of action 554 of drive gear tooth 530 intersects orifice 552. Orifice 552 can be disposed on either a leading flank 532 or a trailing flank 534 of drive gear tooth 530, as suitable for a given application. Relative to the orifice position shown in FIG. 7A, orifice 552 provides a smaller delay interval between discharge of fluid from cavity 550 subsequent to teeth of the drive gear and driven gear unmeshing.

Figure 7C:
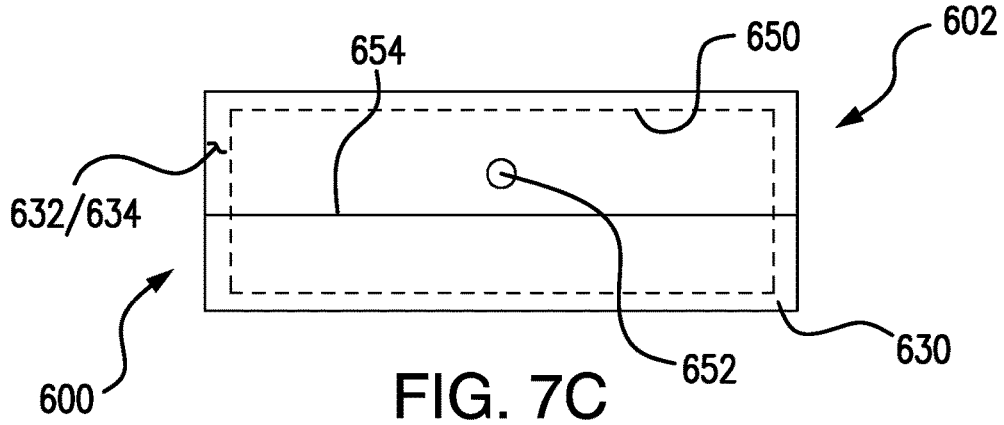

Referring to FIG. 7C, a gear pump 600 is shown. Gear pump 600 is similar to gear pump 100, and additionally includes a drive gear 602 having a drive gear tooth 630 defining a cavity 650 that is in fluid communication with the external environment through an orifice 652. Orifice 602 is circular in shape and is disposed above a lower extreme of the line of action 654 of drive gear 652 on either a leading flank 632 or a trailing flank 634 of drive gear tooth 630. Relative to the orifice position shown in FIG. 7B, orifice 652 provides a s faster discharge of fluid from cavity 550 subsequent to teeth of the drive gear and driven gear unmeshing.

Figure 7D:
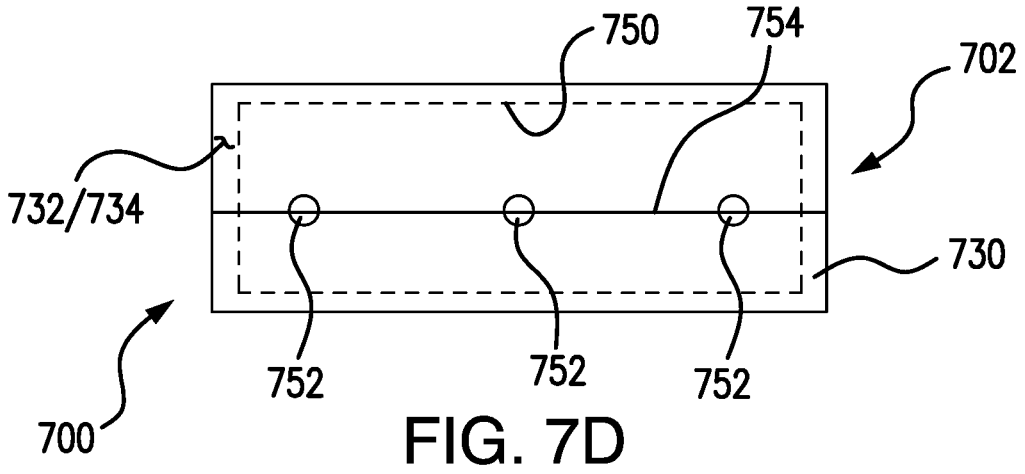

Referring to FIG. 7D, a gear pump 700 is shown. Gear pump 700 is similar to gear pump 100, and additionally includes a drive gear 702 having a drive gear tooth 730 defining a cavity 750 that is in fluid communication with the external environment through a plurality of orifices 752 distributed laterally across a flank of the tooth. Orifices 752 are circular in shape and are arranged such that a lower extreme line of action 754 of drive gear 702 intersects each of orifices 752. Orifices 752 may be disposed on either a leading flank 732 or a trailing flank 734 of drive gear tooth 730. The illustrated arrangement is advantageous when there is relatively axially-induced swirl and/or vorticity.

Figure 7E:
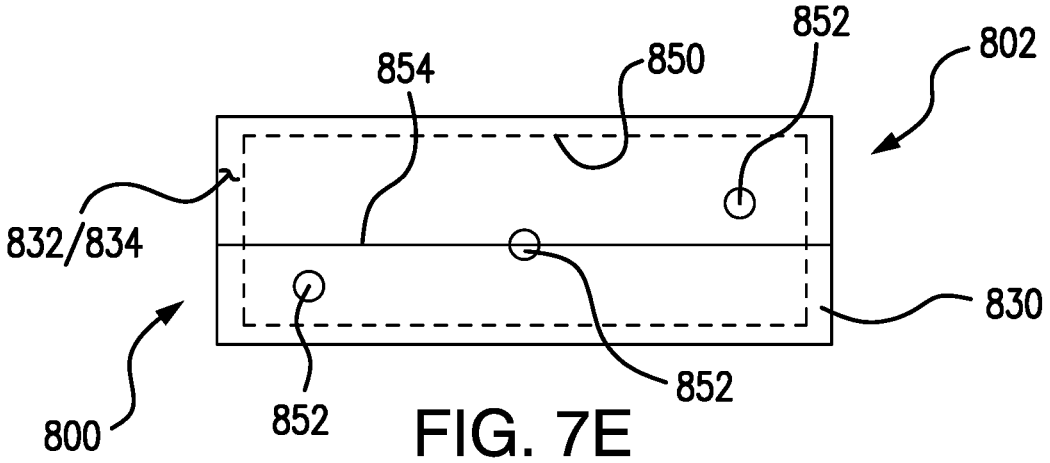

Referring to FIG. 7E, a gear pump 800 is shown. Gear pump 800 is similar to gear pump 100, and additionally includes a drive gear 802 having a drive gear tooth 830. Drive gear tooth 830 defines a cavity 850 that is in fluid communication with the external environment through a plurality of orifices 852 distributed radially across a flank of the tooth. Orifices 852 are circular in shape and are arranged such that a first orifice 852 is arranged radially outward of a line of action 854, a second orifice 852 is intersected by lower extreme line of action 854, and a third orifice 852 is arranged radially inward of lower extreme line of action 854. Orifices 852 may be disposed on either a leading flank 832 or a trailing flank 834 of drive gear tooth 830. The illustrated arrangement is advantageous when there is pronounced axially-induced swirl and/or vorticity.

Figure 7F:
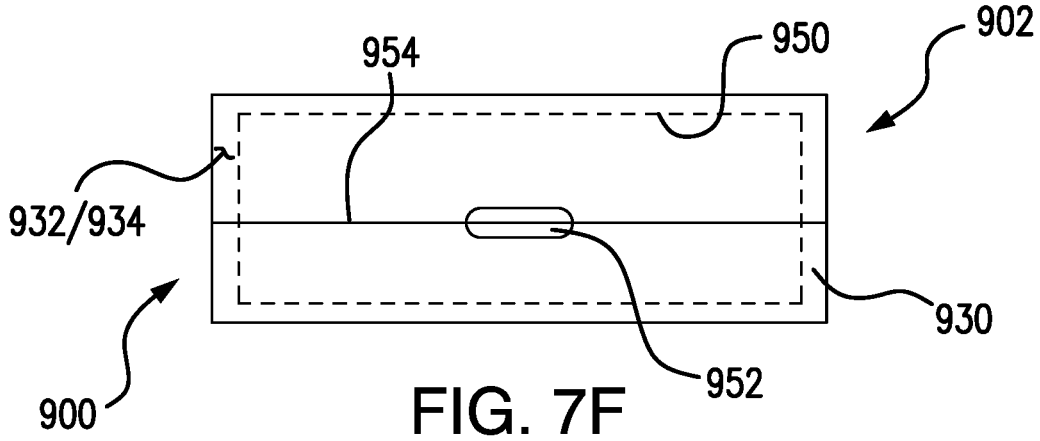

Referring to FIG. 7F, a gear pump 900 is shown. Gear pump 900 is similar to gear pump 100, and additionally includes a drive gear 902 having a drive gear tooth 930 defining a cavity 950 that is in fluid communication with the external environment through an orifice 952. Orifice 952 is oblong or ellipsoid in shape and is disposed along the line of action 954 of drive gear 902, and may be disposed on either a leading flank 932 or a trailing flank 934 of drive gear tooth 930. The oblong or ellipsoid shape allows for relatively large orifice area relative to cavity 950, the rounded contours eliminating stress raisers that can be associated with angles or corners defined within drive gear tooth 930. The illustrated arrangement reduce cavitation in fuel pumps with low or no axially-induced vorticity relatively high flow rates are required from the cavity subsequent to gear teeth of the drive gear and driven gear unmeshing. Although illustrated as being disposed along line of action 954 in FIG. 7F, it is to be understood and appreciated that oblong or ellipsoid orifice 952 may be disposed above line of action 954 or below line of action 954.

The methods and systems of the present disclosure, as described above and shown in the drawings, provide for gear pumps with superior properties, including reduced or substantially eliminated cavitation during fluid pumping. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A gear pump, comprising:

a drive gear with drive gear teeth supported for rotation about a drive gear axis; and a driven gear with driven gear teeth supported for rotation about a driven gear axis, wherein the drive gear is intermeshed with the driven gear such that an inter-tooth volume is defined between the drive gear and the driven gear, wherein one or more of the drive gear teeth or one or more of the driven gear teeth define an internal cavity in fluid communication through an orifice with the inter-tooth volume to reduce cavitation in fluid disposed within the inter-tooth volume, wherein the orifice is defined within a leading flank of the one or more of the drive gear teeth or the one or more driven gear teeth, and wherein the internal cavity is a blind cavity, fluid communication between the internal cavity and the inter-tooth volume being limited to the orifice defined within the leading flank of the one or more of the drive gear teeth or the driven gear teeth.

2. The gear pump as recited in claim 1, wherein the one or more of the drive gear teeth or the one or more of driven gear teeth has a line of action, wherein the line of action intersects the orifice.

3. The gear pump as recited in claim 1, wherein the orifice has a major axis and a minor axis, wherein the major axis has a length that is greater than a length of the minor axis.

4. The gear pump as recited in claim 3, wherein the orifice has a flow area with an ellipsoid shape.

5. The gear pump as recited in claim 1, wherein the orifice is a first orifice defined within a leading flank of the one or more of the drive gear teeth or the one or more of driven gear teeth, wherein the leading flank defines a second orifice fluidly coupling the internal cavity with the external environment.

6. The gear pump as recited in claim 5, wherein the one or more of the drive gear teeth or the one or more of driven gear teeth has a line of action, and wherein the first orifice is offset from the line of action by a greater distance than the second orifice relative to the centerline.

7. The gear pump as recited in claim 1, wherein each of the teeth of the drive gear includes a internal cavity in fluid communication with the external environment through an orifice defined within a leading flank of each of one or more drive gear teeth or the one or more of the driven gear teeth.

8. The gear pump as recited in claim 1, wherein at least one of the drive gear and the driven gear comprises a plurality of interfused layers.

9. The gear pump as recited in claim 8, wherein the the plurality of interfused layers include a material selected from a group including carbon steel, stainless steel, a cobalt-chrome alloy, a nickel-based alloy, a titanium-based alloy, and an aluminum-based alloy.

10. A gear pump, comprising:

a drive gear with drive gear teeth supported for rotation about a drive gear axis; and a driven gear with driven gear teeth supported for rotation about a driven gear axis, wherein the drive gear is intermeshed with the driven gear such that an inter-tooth volume is defined between the drive gear and the driven gear, wherein one or more of the drive gear teeth or the one or more of driven gear teeth define an internal cavity in fluid communication through an orifice with the inter-tooth volume to reduce cavitation in fluid disposed within the inter-tooth volume, wherein the internal cavity has a volume that varies according to pressure of a fluid confined between the one or more of the drive gear teeth or the one or more of the driven gear teeth having the internal cavity and an intermeshed tooth of another gear.

11. A gear pump, comprising:

a drive gear with drive gear teeth supported for rotation about a drive gear axis; and a driven gear with driven gear teeth supported for rotation about a driven gear axis, wherein the drive gear is intermeshed with the driven gear such that an inter-tooth volume is defined between the drive gear and the driven gear, wherein one or more of the drive gear teeth or one or more of the driven gear teeth define an internal cavity in fluid communication through an orifice with the inter-tooth volume to reduce cavitation in fluid disposed within the inter-tooth volume, a compressible insert seated within the internal cavity of the one or more of the drive gear teeth or the one or more of the driven gear teeth.

12. The gear pump as recited in claim 11, wherein the compressible insert includes a polymeric material, fluoropolymer material, or a fluoro-silicone material.

13. A gear pump assembly, comprising:

a housing with an inlet and an outlet;

a drive gear with drive gear teeth supported for rotation within the housing and disposed between the inlet and the outlet;

a driven gear with driven gear teeth supported for rotation about a driven gear axis between the inlet and the outlet; and first and second bearing carriers disposed on axially opposite sides of the drive gear and the driven gear, wherein the first and second bearing carriers rotatably support the drive gear along the drive gear axis and the driven gear along the driven gear axis, wherein the drive gear is intermeshed with the driven gear such that one or more of the drive gear teeth are in sliding contact with one or more of the driven gear teeth, wherein each of the drive gear teeth or the driven gear teeth define an internal cavity that is in fluid communication through an orifice with an inter-tooth volume defined between the drive gear, the driven gear, the first bearing carrier, and the second bearing carrier to reduce cavitation in fluid disposed within the inter-tooth volume wherein the orifice is defined within a leading flank of the one or more of the drive gear teeth or the driven gear teeth, and wherein the internal cavity is a blind cavity, fluid communication between the internal cavity and the inter-tooth volume being limited to the orifice defined within the leading flank of the one or more of the drive gear teeth or the one or more of the driven gear teeth.

14. A method of controlling cavitation, comprising:

confining fluid in an inter-tooth volume of a gear pump;

charging an internal cavity defined within a gear tooth with high-pressure fluid through an orifice fluidly coupling the gear tooth with the inter-tooth cavity according to fluid pressure change within the inter-tooth volume, wherein the orifice is defined within a leading flank of the gear tooth, the internal cavity being a blind cavity such that fluid communication between the internal cavity and the inter-tooth volume being limited to the orifice defined within the leading flank of the one or more of the drive gear teeth or the driven gear teeth;

blocking the orifice with trailing face of an intermeshed gear tooth;

carrying the high-pressure fluid to a region of the inter-tooth volume having low pressure; and discharging the high-pressure fluid from the internal cavity into the region of the inter-tooth volume having low pressure.

15. The method as recited in claim 14, wherein charging the internal cavity include compressing a compressible inert disposed within the internal cavity.

16. The method as recited in claim 14, wherein discharging the high-pressure fluid includes accelerating discharge of the high-pressure fluid with a compressible insert disposed within the internal cavity.

* * * * *